US006283404B1

(12) United States Patent
Fournier

(10) Patent No.: US 6,283,404 B1
(45) Date of Patent: Sep. 4, 2001

(54) LOCK SHAFT FOR PAPER CORES

(76) Inventor: Emile Fournier, 179 Edgeland Road, Calgary, AB (CA), T3A 2Y3

( * ) Notice: Subject to any disclaimer, the term of this patent is extended or adjusted under 35 U.S.C. 154(b) by 0 days.

(21) Appl. No.: 09/282,641

(22) Filed: Mar. 31, 1999

(51) Int. Cl.[7] ..... B65H 75/24
(52) U.S. Cl. ..... 242/571.6; 242/530.1
(58) Field of Search ..... 242/571.6, 571.7, 242/530.1; 279/2.2; 192/76

(56) References Cited

U.S. PATENT DOCUMENTS

| | | | | |
|---|---|---|---|---|
| 2,561,745 | * | 7/1951 | Lerch | 242/571.7 |
| 3,007,652 | * | 11/1961 | Heckman | 242/571.7 |
| 3,029,037 | | 4/1962 | Williams et al. | 242/72 |
| 3,817,468 | * | 6/1974 | Smolderen et al. | 242/530.3 |
| 4,519,620 | * | 5/1985 | Keith | 242/571.7 |
| 4,767,077 | * | 8/1988 | Kataoka | 242/571.7 |
| 5,012,987 | | 5/1991 | Dropczynski | 242/56 R |

* cited by examiner

*Primary Examiner*—John Q. Nguyen
(74) *Attorney, Agent, or Firm*—Sheldon H. Peter

(57) ABSTRACT

A material transfer system is disclosed using a hollow cylindrical lock shaft for rewinding flexible material from an original core to at least one transfer core. The shaft has an interior and exterior wall, a length, and at least one curved locking base recessed along the length. The bases have a first and second wall with a floor having a progressively decreasing radius from the first to the second wall. Multiple legs extend radially inwardly from the interior wall and have gripping feet are at their distal ends. A plurality of locking ribs extend the length of the locking bases and are affixed to the floor at the each end of the rib. The locking ribs have a diameter sufficient to enable the locking rib outer circumference to extend beyond the circumference of the shaft exterior. At least one locking strip is affixed to at least a portion of the shaft's length, extending beyond the circumference of the exterior wall to prevent the cores from moving freely. The locking strip can be affixed to the locking base floor or a channel can be placed in the shaft and the locking strip being affixed within the channel.

19 Claims, 9 Drawing Sheets

LOCK SHAFT FOR PAPER CORES

BACKGROUND OF THE INVENTION

1. Field of the Invention

The disclosed relates to an improved, economical, lock shaft for use in rewinding materials from a full-length core to multiple, smaller cores.

2. Brief Description of the Prior Art

During the manufacturing of rolled materials, such as fabric, paper, adhesives. etc., the machinery used places the material onto long cores. The material is subsequently cut, while on the original core, and the cut material is rerolled onto new cores cut to the appropriate width. The problem of rewinding the material onto smaller cores and removing those cores has, until now, required expensive, complicated equipment.

In U.S. Pat. No. 3,029,037 a shaft is disclosed for rewinding that is expanded during the rewinding process and unexpanded for removal of the cores. The elongated, substantially cylindrical member has a portion, intermediate the ends, which is slotted. The slots radially extend outwardly when pneumatic, or other pressure-fluid-operated means are applied. This radial expansion of the intermediate portion, is accompanied by a slight bowing outwardly of the wall of the cylindrical member. Although the '037 device does accomplish the desired effect, the cost of the multi-pieced shaft and pneumatics is substantial and the manufacturing more complicated.

Drum-type winders are employed in particular to wind webs of paper or cardboard deriving from a supply reel into smaller individual reels, whereby the web from the supply reel is simultaneously slit longitudinally into individual webs. They have two or more drums and the reels are wound axially adjacent onto cores in the valley between two drums. Once the drums have attained the desired diameter, the longitudinally slit individual webs arriving from the supply reel are separated, the finished reels unloaded and fresh cores inserted. U.S. Pat. No. 5,012,987 improves on the prior art drum winders by incorporating core accommodation to enable different sized cores to be used.

The foregoing drum winders, however, transfer into smaller diameter cores and no means are provided to enable rewinding to smaller length cores.

SUMMARY OF THE INVENTION

A material transfer system is disclosed that uses a hollow cylindrical lock shaft for rewinding flexible material from an original core to at least one transfer core. The shaft has an interior wall, an exterior wall, a length, and at least one curved locking base. Preferable more than one curved base is recessed along the length of the shaft. The curved locking bases extend along the length and are recessed within the exterior wall of the shaft. The locking bases have a first wall and a second wall with a floor having a progressively decreasing radius from the first wall to the second wall. Multiple legs, having a length less than the radius of the shaft, extend radially from the interior wall for at least a substantial portion of the shaft's length. Multiple gripping feet are at the distal ends of the legs distal end and are dimensioned to receive an inner shaft in a manner to prevent movement between the two shafts. The length of the legs and feet are dependent upon the distance between the interior of the lock shaft and the exterior of the inner shaft.

A plurality of locking ribs extending substantially the length of the locking bases approximately equidistant between the first and second walls and are affixed to the floor at the each end of the locking rib. A pair of slots are placed at the end of each locking base to receive, and secure, the locking ribs. Alternatively receiving holes can be placed at each end and the locking ribs can be affixed through use of the receiving holes. The locking ribs have a diameter sufficient to enable the locking rib outer circumference to extend beyond the circumference of the shaft exterior wall about $25{,}000^{th}$ to $125{,}000^{th}$ of an inch.

At least one locking strip is affixed to at least a portion of the shaft's length, extending beyond the circumference of the exterior wall to prevent the cores from moving freely. The locking strip can be affixed to the locking base floor or a channel can be placed in the shaft and the locking strip affixed within the channel.

To transfer material, a rotating interior shaft, dimensioned to be received by multiple gripping feet in a non-slip manner, is placed within the lock shaft. The interior shaft has a gear member to rotate the interior shaft in a clockwise and counterclockwise direction. Transfer cores are placed on the lock shaft to receive the material. Rotating the gear member in a first direction prevents rotation of the transfer core relative to the interior shaft by wedging the locking rib between the transfer core and locking base proximate the first wall. The material can then be wound onto the transfer core without the core slipping. Rotating the gear member in a second direction enables rotation and removal of the transfer core relative to the interior shaft by placing the locking rib proximate the second wall.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
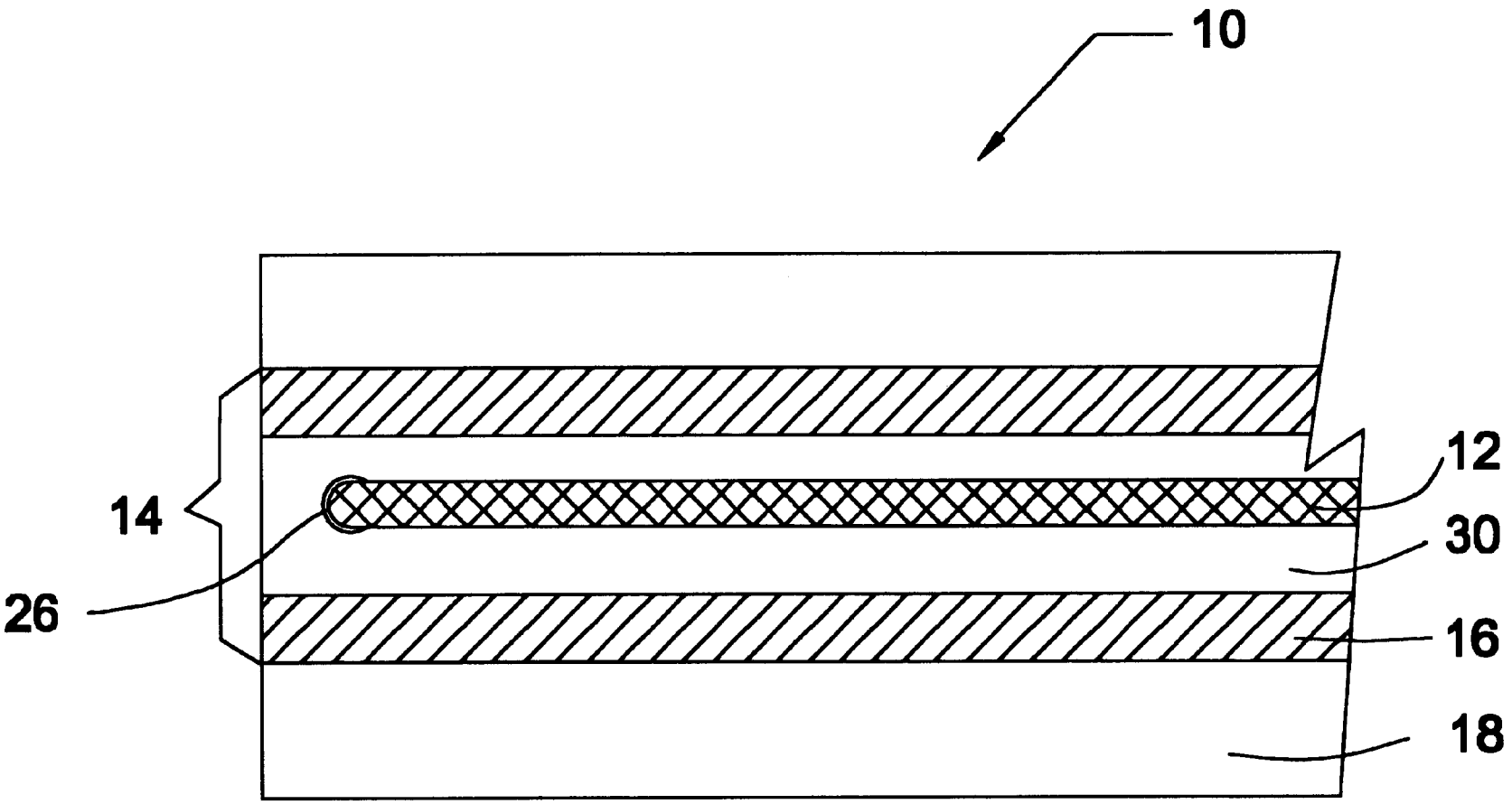
FIG. 1 is a fragmented top view of the lock shaft illustrating the locking ribs.
Figure 2:
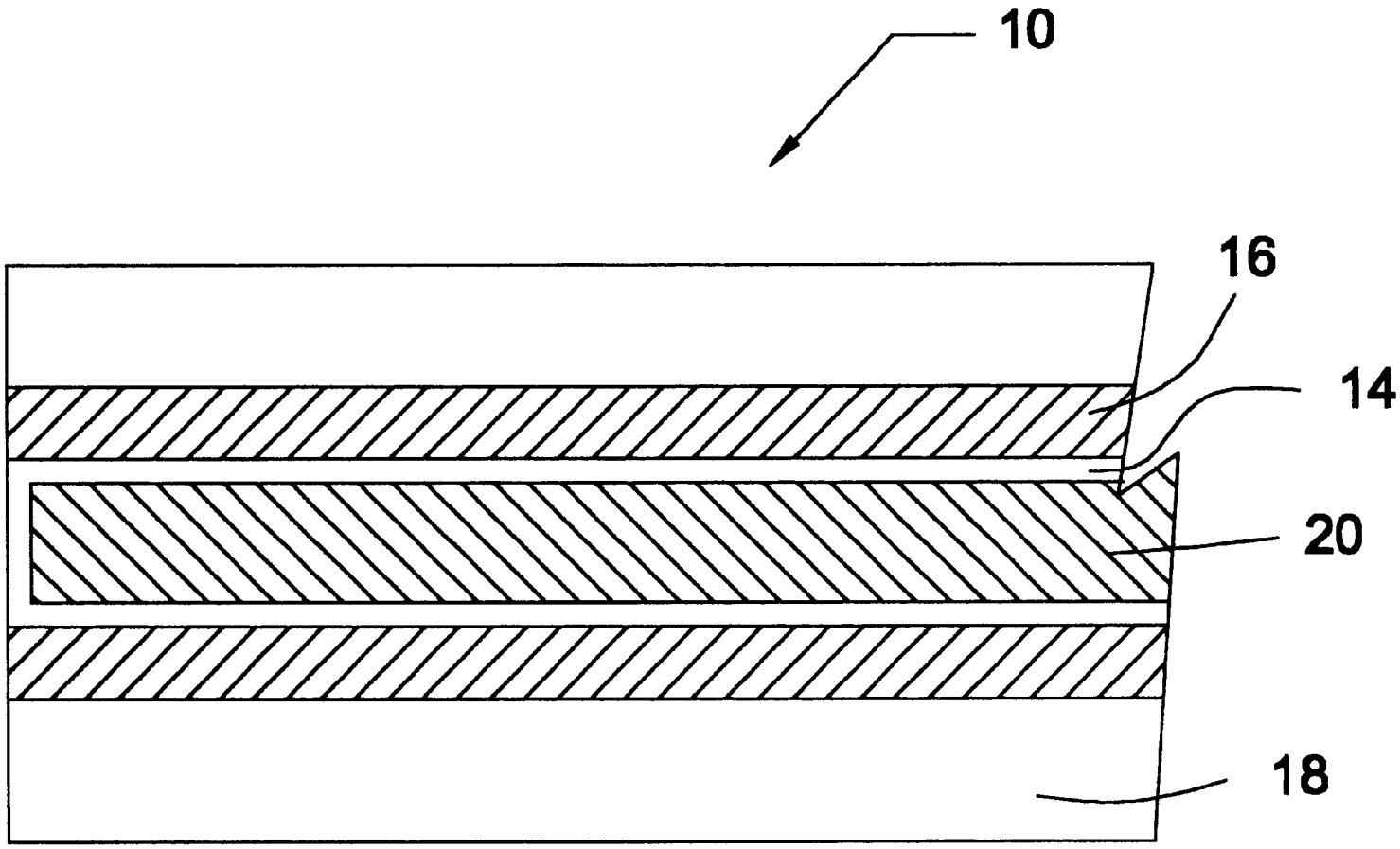
FIG. 2 is a fragmented top view of the lock shaft illustrating the retaining strip.

The disclosed device enables materials manufactured on a single support core to be cut into predetermined sections and rewound onto new cores. Many materials, from fabric to adhesive tapes, are initially manufactured in rolls up to about eight (8) feet. The eight (8) foot widths are not, however, easily handled and often do not fit the needs of the end user.

The problem to date has not been in cutting the material, but rather transferring the cut sections of material from the original core to appropriate sized transfer cores and then easily removing the transfer core sections from the shaft. To accomplish this the lock shaft 10 illustrated in FIGS. 1–5 uses a pair of locking rib)s 12 that interact with two of the three curved locking bases 14. The locking bases 14 are formed by the recessed floor 30 and wall 16. A locking strip 20 is placed within the third recessed locking base 14 and assists in maintaining the core on the clutch during rotation.

The lock shaft 10 is a hollow cylinder 18 having an outer diameter slightly less than the inner diameter of the core. The dimensioning is such that the core could, without the locking strip, slip easily on and off the cylinder 18. The friction fit between the lock shaft 10 and the core is achieved through use of the locking strip 20. The locking strip 20 extends beyond the circumference of the cylinder 18 in the range of 1/16 to 1/4 inch to provide the required resistance. This dimension can vary dependent upon the dimensioning of the cylinder and the above is based on a cylinder having a 3 inch diameter. The locking strip illustrated has been placed in a locking base, however a channel having an alternative configuration can also be used. The main criteria is the extension of the strip a sufficient distance above the cylinder diameter to prevent the transfer core from spinning on the lock shaft. The use of a soft material, such as foam rubber, provides sufficient resistance to prevent the core from rotating excessively, as well as preventing any distortion of the core during the mounting and removal process. Excessive hardness to the locking strip 20 makes mounting and removal of the cores more difficult and could cause damage to the interior of the cores. The locking strip 20, as illustrated, extends the length of the cylinder 18, however the locking strip can cover only a portion of a strip along the length of the cylinder. This is dependent upon the resistance required and materials used and will be evident to those skilled in the art. Alternatively, the locking strip can be a thin strip of material affixed to the outside exterior of the cylinder and not recessed within the locking base.

Figure 9:
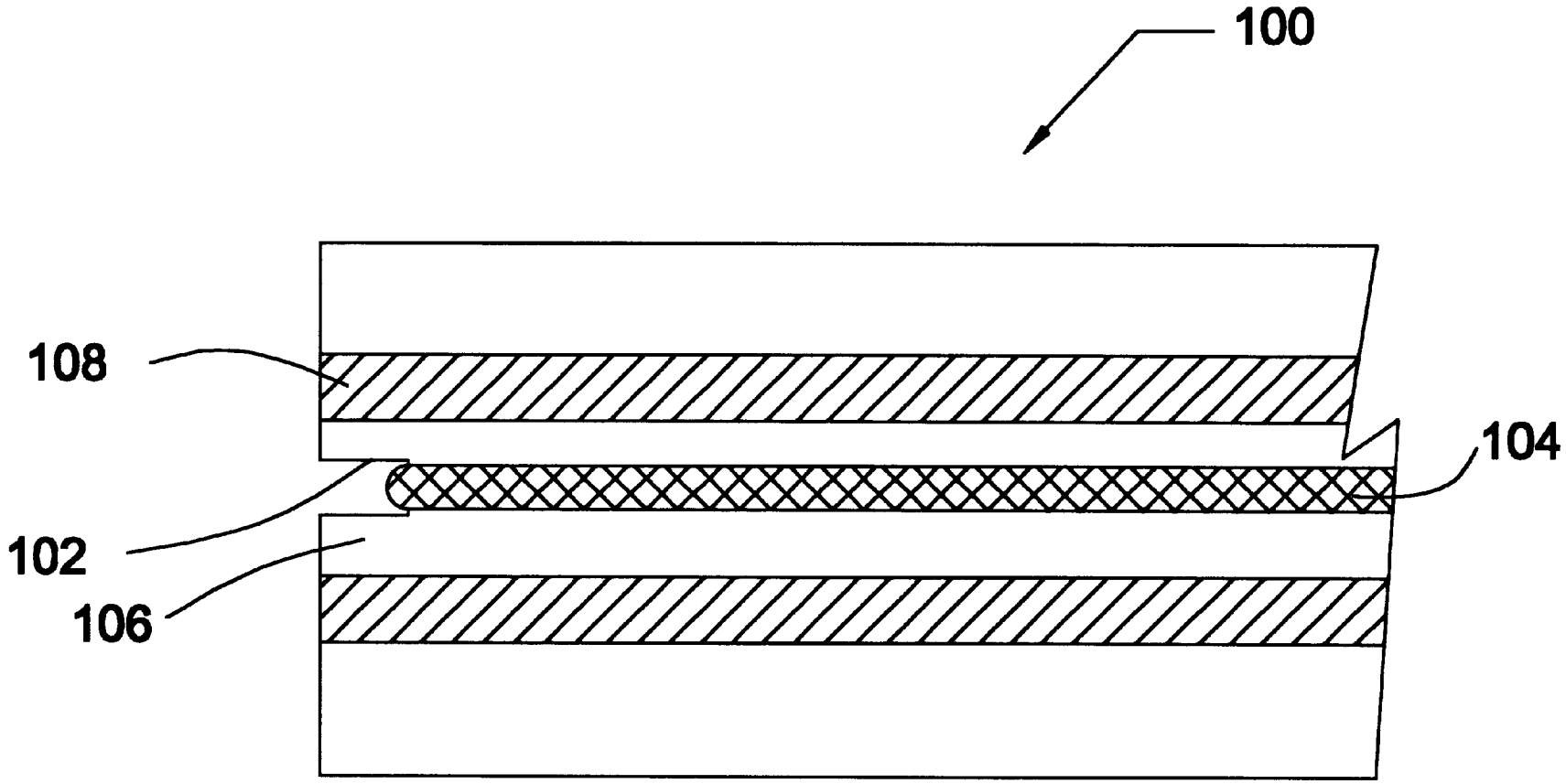
FIG. 9 is a fragmented top view of an alternate embodiment of the lock shaft.

The locking ribs 12 are cylindrical rubber, or rubber like, cords that end within the interior of the cylinder 18. A material known as O-ring rubber having a diameter of about 0.5 cm, provides the appropriate thickness, hardness and stretchability. Other materials that meet these criteria can be substituted and will be obvious to those in the field. The locking ribs 12 can be inserted into receiving holes 26 provided at each end of the cylinder 18 and secured within the cylinder 18 through means appropriate to the materials of manufacture, such as adhesives or solder. Preferably, as illustrated in FIG. 9, the ends of the cylinder 100 are provided with a slot 102 to receive the locking ribs 104. The slots 102 are in the range of about ½ inch long and have a width slightly greater than the locking ribs 104. Preferably the slots 102, or receiving holes 26, are positioned in approximately the middle of the floor 106 of the locking base walls 108. This positioning places the locking rib 104 equidistant between the two locking base walls 108 and ensures that the locking rib 104 rotates to either lock or release the transfer core 50. The locking rib 104 is brought through the slot 102 and knotted within the cylinder 100. The natural resistance of the rubber maintains both knotted ends of the locking ribs 104 within the slots 102. Although the preferred cross sectional configuration of the locking ribs 104 are round, other multi-sided polygons can be used. To provide optimum smoothness, the locking ribs disclosed here must have the ability to roll within the curved locking bases disclosed further herein. The diameter of the locking ribs 12 is such that when the locking rib 12 is mounted, the outer surface of the locking rib 12 extends beyond the outer circumference of the cylinder 18 in the range of about 25,000 to 125,000$^{th}$ of an inch. The diameter of the locking ribs is dependent upon the depth of the curved locking bases and diameter of the cylinder as the locking rib 12 must be in sufficient communication with the core 50 to force the rib to roll into position in either the upper or lower base points. Additionally, the number of locking ribs is dependent upon the diameter of the cylinder. The disclosed cylinder 18 is dimensioned to receive a transfer core having a three (3) inch inner diameter and easily locks the core in position using two locking ribs. The number of locking ribs will be increased or reduced dependent upon the diameter of the cylinders and will be obvious to those skilled in the art.

The cylinder 18 is preferably an aluminum extrusion to enable convenient, economical manufacturing, although other means of manufacture can be used. Tile material must have sufficient density to withstand the weight of tile material covered cores and the associated rotation, as well as provide resistance to the rubber. The interior of the cylinder 18 has three legs 22 that extend into the interior and grip, through use of feet 24. the rotating shaft of the machine being used. The curvature of the feet 24 will vary dependent upon the diameter of the cooperating, interior rotating shaft. The combined length, or radius, of the legs and feet is dependent upon the difference between the lock shaft diameter required for the transfer core and the interior rotating shaft. In some instances, the feet 24 can be directly adjacent the curved locking bases 14 and the required dimensioning will be obvious to those skilled in the art. To enable maximum grip, the legs 22 and feet 24 extend the entire length of the cylinder 18. The legs 22 and feet 24 must have sufficient thickness to support the cores, material and cylinder. For example, in a cylinder having a 7 to 7.5 cm diameter, the legs and feet would have a thickness of about 0.25 to 0.75 cm. The feet, as illustrated, are designed as one method of receiving an interior rotating shaft and other designs can be used to maintain the two shafts adjacent one another in a non-rotatable manner. Although the disclosed lock shaft is manufactured to interact with existing equipment, the rotating shaft can be manufactured in the same manner as the lock shaft, thereby enabling the cores to be placed directly onto the shaft. Other hard materials, such as steel, can be used and the cylinder machined to reach the disclosed configuration. When extruded, it is convenient to extend the legs and feet the length of the cylinder. In some applications, however, this length is not necessary to secure the lock shaft to the inner rotating shaft and will be a matter of convenience of manufacture.

Figure 3:
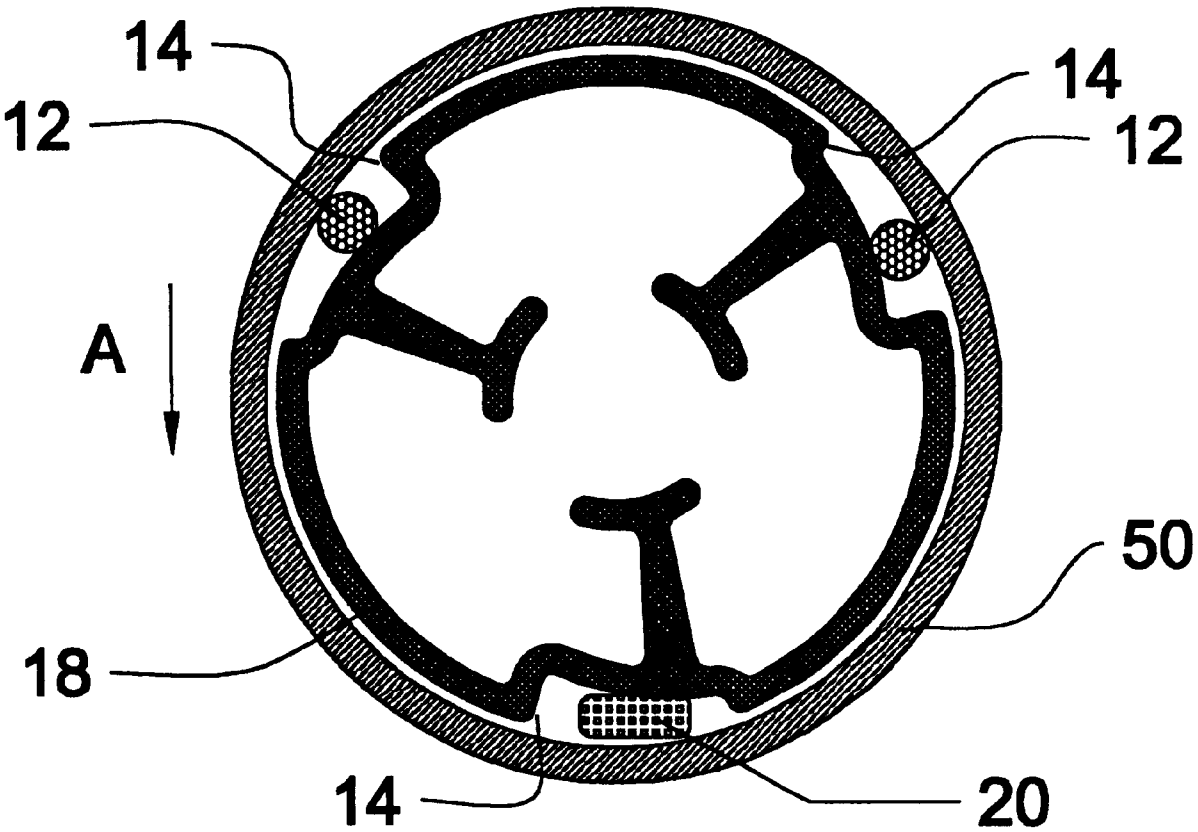
FIG. 3 is a cut away end view of the lock shaft and core in a resting positions illustrating the configuration of the locking ribs and retaining strip.
Figure 4:
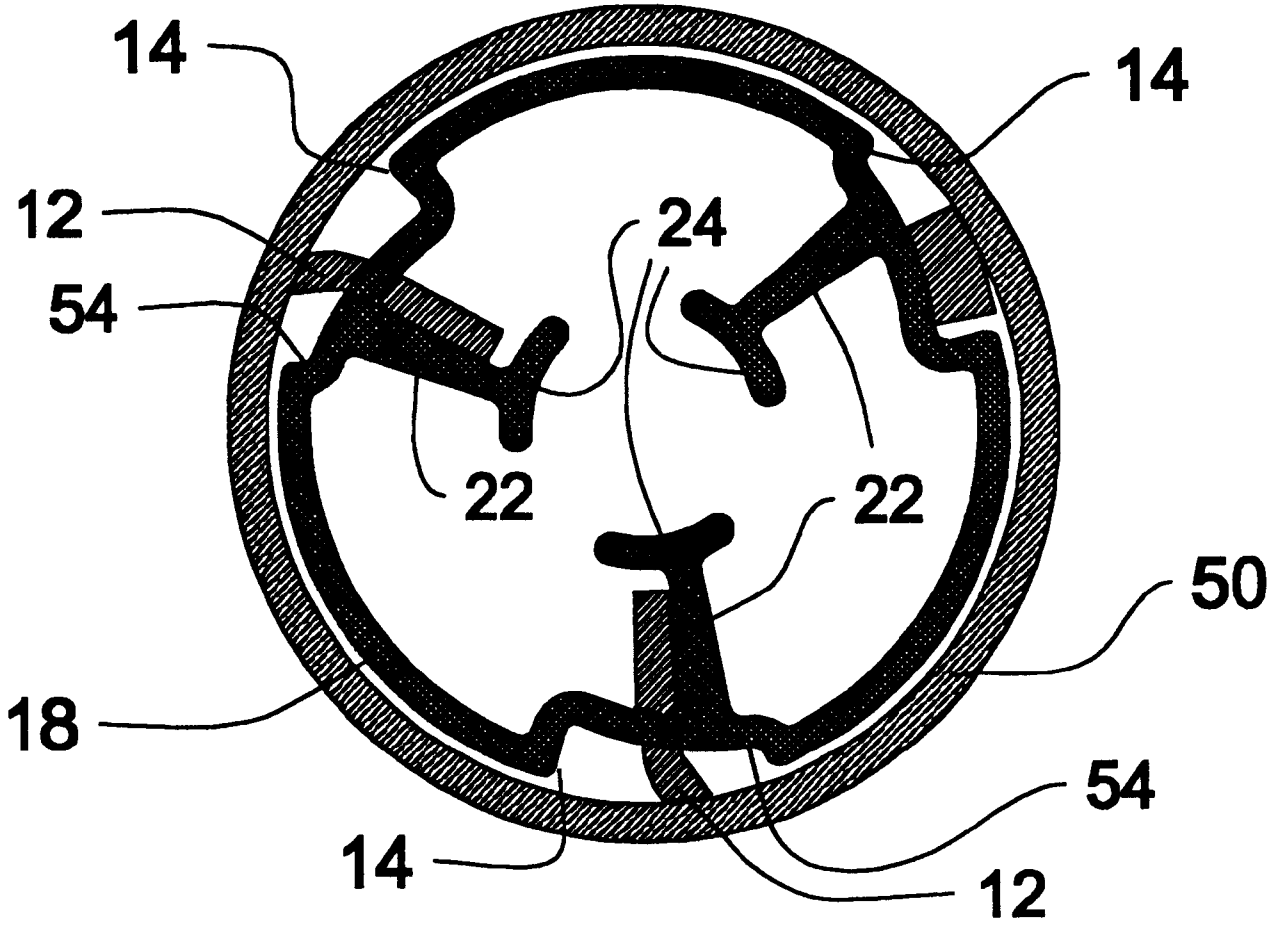
FIG. 4 is an end view of the lock shaft and core in the locking position.
Figure 5:
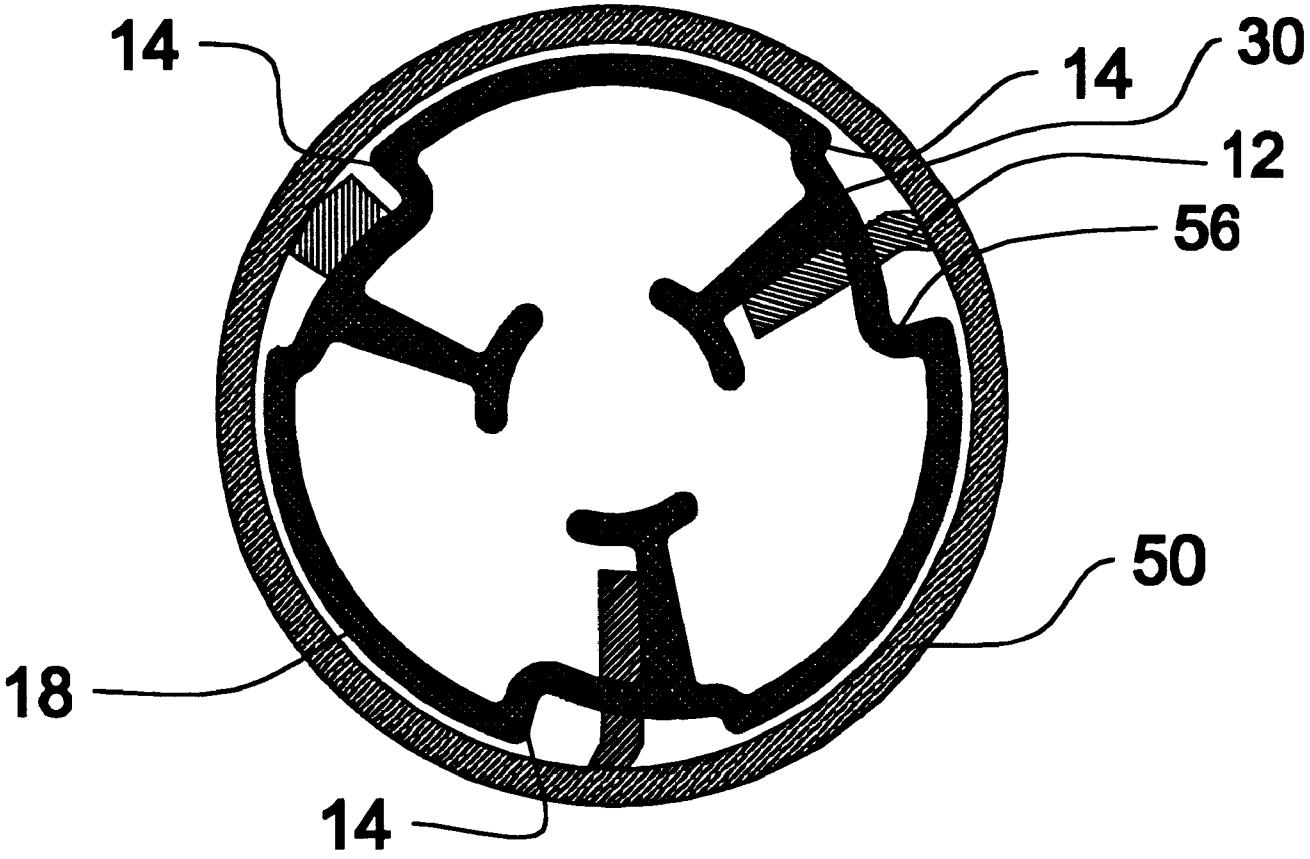
FIG. 5 is an end view of the lock shaft and core in the released position.

The three curved locking bases 14, as seen more clearly in FIGS. 3–5, are recessed from the cylinder 18. FIGS. 4 and 5 are an end view and the locking ribs 12 are illustrated extending into the hollow core of the cylinder 18. In FIG. 4 the cross-sectional configuration of the locking ribs 12 and the locking strip 20 is illustrated.

Figure 6:
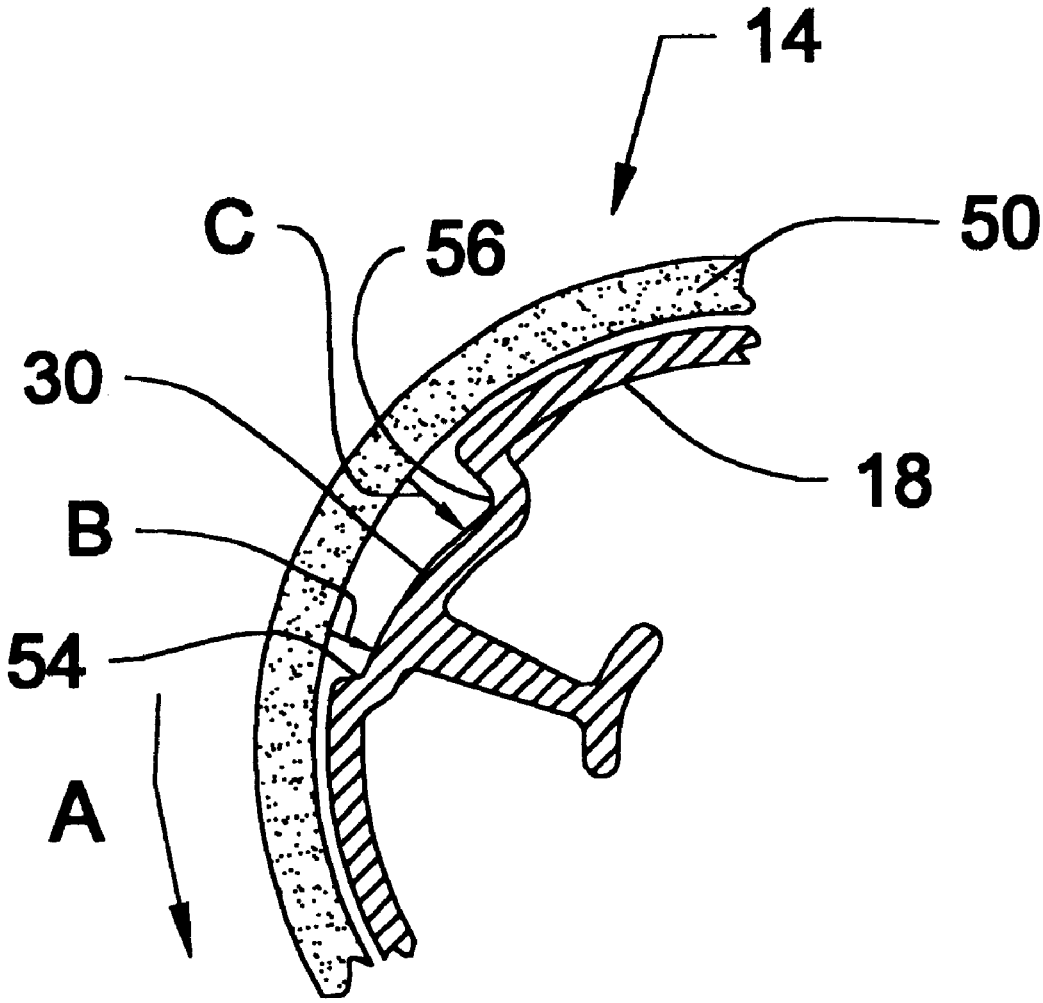
FIG. 6 is a side view of a portion of the recessed locking portion of the lock shaft.

The curvature of the floor 30 of the locking base 14, illustrated in more detail in FIG. 6, is recessed along an ascending plane, when viewed in the counterclockwise direction of Arrow A. The interior side of the core 50 is used in this figure to provide a reference point for the curved locking base floor 30. As can be seen, the distance between the core 50 and the upper base point 54, represented by Arrow B, is less than the distance between core 50 and lower base point 56 (Arrow C). The variation of the distance enables the locking ribs 12 to either lock or release the core 50, depending upon their placement between the core 50 and the floor 30. The curvature of the floor 30 is critical for determining the outer diameter of the locking ribs 12 and the interaction between the two must be taken into account when designing the lock shaft.

In FIG. 3, the core 50 has been initially placed onto the lock shaft 10. In this embodiment, the locking ribs 12 are compressed an amount that is equal to their extension above the cylinder 18. At this point, the cylinder 18 is free to move in either a clockwise or a counterclockwise direction within the core 50. In FIG. 4 the cylinder 18 has been rotated in a counterclockwise direction, locking the core 50 onto the cylinder 18. As can be seen, the locking ribs 12 are placed between the core 50 and the upper base point 54. In this position, the upper base point 54 is too high for the locking rib 12 to provide the clearance necessary to enable the core 50 to rotate. The locking rib 12 becomes wedged between the upper base point 54 and the core 50, preventing further rotation in the counterclockwise direction. The locking rib 12 must provide sufficient resistance to prevent crushing, enabling rotation, while providing enough pliability, to enable sufficient deformity to lock the core in place. Further, the material of manufacture should provide surface resistance to assist in preventing further core rotation.

In FIG. 5, the core 50 has been rotated in the clockwise direction, positioning the locking ribs 12 between the core 50 and the lower base point 56. Bid moving the locking rib 12 towards the lower base point 56, the rib 12 recesses within the floor 30. preventing interference with the core 50. The core 50 can be easily turned and removed in this position. It should be noted that the reference herein to clockwise and counterclockwise is for reference only and the locking and releasing of the locking ribs is dependent upon the rotation of the winding machinery.

Figure 7:
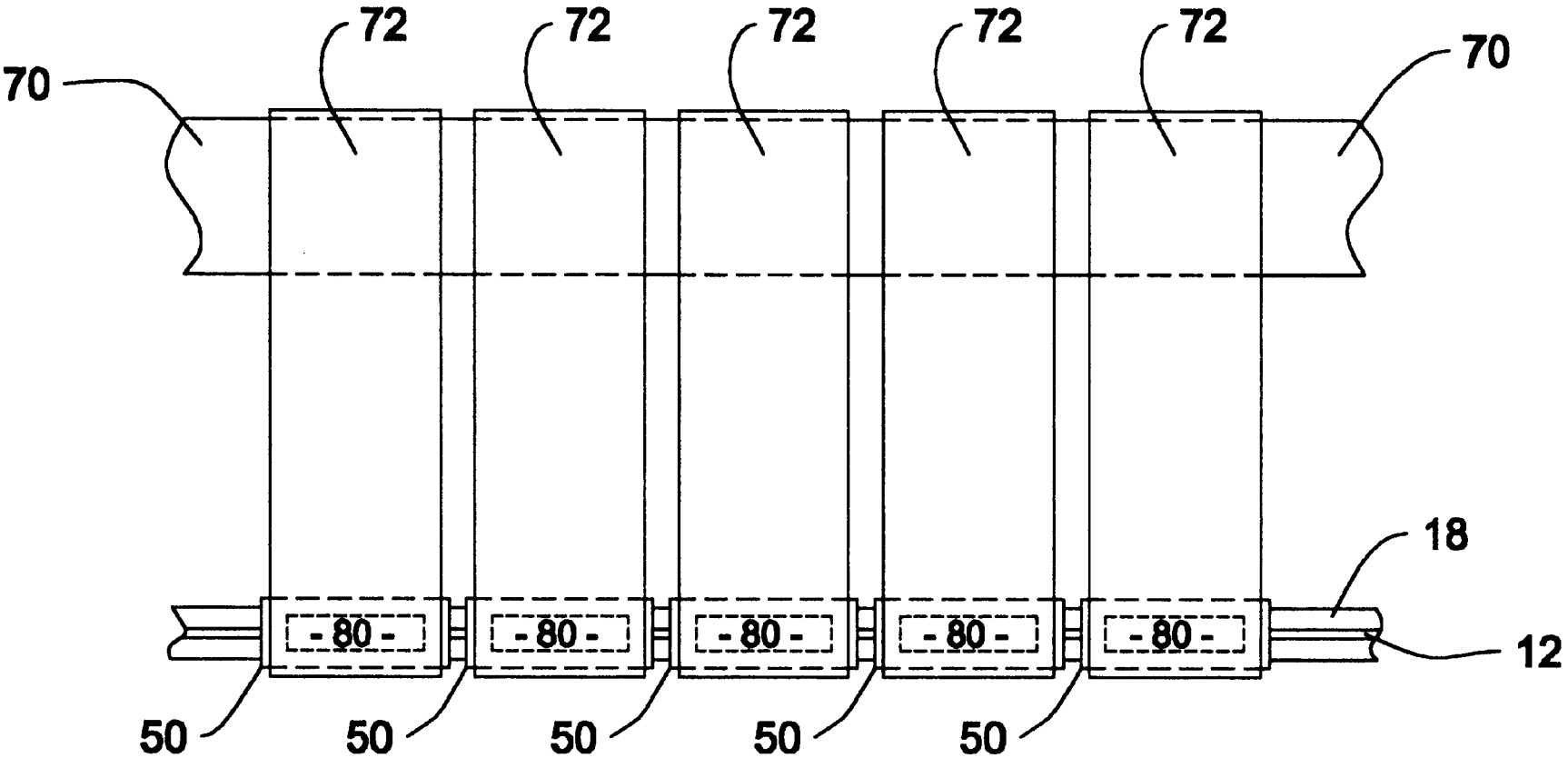
FIG. 7 is a top view of the transfer of material between the cutting shaft and the lock shaft; and, FIG. 8 is a top view of an example machine arrangement for transferring material between the original core and smaller cores.
Figure 8:
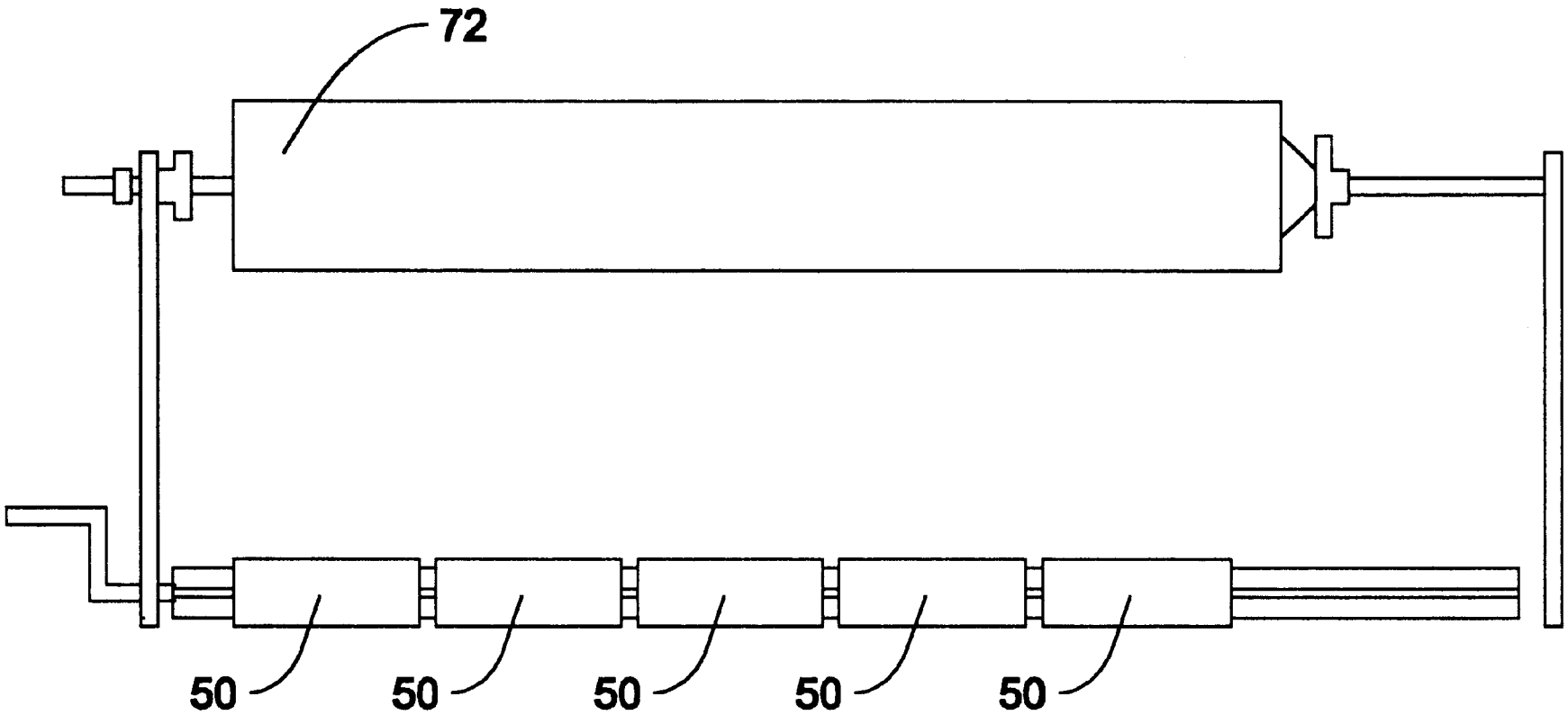

The disclosed lock shaft 10 is used to take material 72 rolled at the time of manufacture and rewind the material 72 onto transfer cores 50. The material can be cut widthwise into multiple widths and rewound onto smaller transfer cores. Alternatively material can be rewound onto a roll having the same width as the original with only a portion of the length of material transferred. As illustrated in FIGS. 7 and 8, the material 72 is placed on a cutter shaft 70 and the roll is cut widthwise by the cutter (not shown) currently in use. At that time the material 72, slit into a predetermined number of sections, remains rolled on the original core. Transfer cores 50, the width of the cut sections of material, are placed adjacent one another on the cylinder 18. The ends of the material 72 is then taken to the cores 50 and secured through tape 80, adhesive or other means known in the art. The cylinder 18 is then wound in the counterclockwise direction, or locked direction, and the material 72 transferred from the original core on the cutter shaft 70 to the cores 50. Once all material 72 has been transferred, the ends are secured to the core 50, and each individual core 50 is rotated clockwise, releasing the locking ribs 12, and the core 50 to the unlocked position.

What is claimed is:

1. A material transfer system comprising a hollow cylindrical lock shaft for rewinding flexible material from an original core to at least one transfer core, said shaft having:

an interior wall, an exterior wall, a length, multiple curved locking bases, each of said multiple curved locking bases extending along said length and being recessed within said exterior wall of said lock shaft, each of said locking bases having a first wall and a second wall with a floor there between, said floor having a progressively decreasing radius from said first wall to said second wall, multiple legs, said legs extending radially inwardly from said interior wall, said legs having a length less than the radius of said lock shaft and extending along a substantial portion of said length;

multiple gripping feet, said gripping feet being at respective distal ends of each of said legs and being dimensioned to receive an inner shaft;

a plurality of flexible locking ribs having a first end and a second end, each of said locking ribs extending substantially said length of each of said locking bases approximately equidistant between said first wall and said second wall, said first end and said second end of each of said locking ribs being affixed to said floor of said locking bases;

at least one locking strip, said locking strip being a flexible material affixed to at least one of said locking bases and extending along, at least a portion of said length beyond said exterior wall circumference;

wherein a transfer core placed over said lock shaft and rotated in a first direction, causes each of said locking ribs to rotate toward said second wall enabling said transfer core to rotate around said lock shaft and rotating said transfer core in a second direction causes each of said locking ribs to rotate toward said first wall, thereby preventing said transfer core from further rotation relative to said lock shaft.

2. The transfer system of claim 1 wherein said locking ribs have a diameter sufficient for said locking ribs outer circumference to extend beyond said exterior wall circumference when said transfer core is rotated in said second position and prevented from further rotation and remain below said exterior wall circumference when said transfer core is rotated in said first position and free to rotate.

3. The transfer system of claim 2 wherein said locking ribs extend beyond said exterior wall circumference from about $25{,}000^{th}$ to $125{,}000^{th}$ of an inch.

4. The transfer system of claim 2 wherein said locking strip is affixed to said floor at least one of said multiple curved locking bases.

5. The transfer system of claim 1 wherein said lock shaft is placed onto a rotating interior shaft dimensioned to be received by said multiple gripping feet in a manner to prevent slipping between said interior shaft and said lock shaft, said interior shaft a gear member to rotate said interior shaft in a clockwise and counterclockwise direction.

6. The transfer system of claim 5 further comprising at least one transfer core placed on said lock shaft to receive said flexible material from said original core, wherein rotating said gear member in said first direction prevents rotation of said lock shaft and said transfer core relative to said interior shaft be wedging each of said locking ribs between said transfer core and each of said locking bases proximate said first wall, thereby said material to be wound onto said transfer core; and rotating said gear member in a second direction enables rotation and removal of said transfer core relative to said lock shaft by placing said locking ribs proximate said second wall.

7. A hollow cylindrical lock shaft having:

an interior wall, an exterior wall, a length, at least one curved locking base extending along said length, said locking base being recessed within said exterior wall of said shaft and having a first wall and a second wall with a floor there between, said floor having a progressively decreasing radius from said first wall to said second wall, at least one flexible locking rib, said locking rib having a first end and a second end and extending substantially said length of said locking base, said first end and said second end of said at least one locking rib being affixed to said floor of said locking base.

8. The lock shaft of claim 7 further comprising at least one pair of receiving holes, said receiving holes being proximate each end of said floor of each of said locking base and dimensioned to receive said first end and said second end of said at least one locking rib.

9. The locking shaft of claim 7 further comprising at least one pair of receiving slots, said receiving slots being accessible from each end of said floor of each of said locking bases and dimensioned to receive said at least one locking rib.

10. The lock shaft of claim 7 further comprising multiple legs, said legs extending radially inwardly from said interior wall, said legs having a length less than the radius of said shaft and extending along at least a substantial portion of said shaft length.

11. The lock shaft of claim 10 further comprising multiple gripping feet, said gripping feet being at respective distal ends of said legs and being configured to receive an inner shaft.

12. The lock shaft of claim 7 wherein said at least one locking rib is secured approximately equidistant between said first wall and said second wall.

13. The lock shaft of claim 7 further comprising at least one locking strip, said locking strip affixed to, and extending along, at least a substantial portion of said length.

14. The lock shaft of claim 13 wherein said locking strip is affixed to said floor of said locking base.

15. A hollow cylindrical lock shaft comprising:

an interior wall, an exterior wall, a length, at least one curved locking base extending along said length, said locking base being recessed within said exterior wall of said shaft and having a first wall and a second wall with a floor there between, said floor having a progressively decreasing radius from said first wall to said second wall;

at least one flexible locking rib, said locking rib having a first end and a second end and extending substantially said length of said locking base and affixed to said floor at said first end and said second end of each said at least one locking rib there by securing said locking rib approximately equidistant between said first wall and said second wall;

multiple legs, said legs extending radially inwardly from said interior wall, said legs having a length less than the radius of said shaft and extending along said length;

multiple gripping feet, said gripping feet being at respective distal ends of said legs and extending along said length, said gripping feet being configured to receive an inner shaft;

at least one locking strip, said locking strip affixed to, and extending along, at least a portion of said locking base length.

16. The shaft of claim 15 wherein each of said at least one said locking rib is cylindrical and have a diameter sufficient for said locking rib outer circumference to extend beyond said lock shaft outer circumference when said at least one locking rib is positioned adjacent to said first wall.

17. The shaft of claim 15 wherein said at least one locking strip extends slightly above said exterior wall circumference.

18. The method of transferring flexible material wound on a single core to multiple transfer cores using a hollow cylindrical lock shaft having an interior wall, an exterior wall, a length, at least one curved locking base extending along said length, said locking base being recessed within said exterior wall of said shaft and having a first wall and a second wall with a floor there between, said floor having a progressively decreasing radius from said first wall to said second wall, multiple griping members being dimensioned to receive and secure to an inner shaft; at least one flexible locking rib extending said length of each of said at least one curved locking base, said at least one locking rib having ends affixed to said floor; at least one locking strip, said locking strip affixed to, and extending along, said length of said locking base;

comprising the steps of:

a) placing an original core of flexible material on a relative rotatable mechanism;

b) placing said lock shaft onto an inner rotatable shaft parallel to said original core in a non-rotatable connection;

c) placing a least one transfer core onto said lock shaft;

d) securing an open end of said flexible material to said transfer core;

e) rotating said inner rotatable shaft in a first direction to move said at least one locking rib to form a wedge between said transfer core and said first wall to enable said transfer core to rotate in conjunction with said lock shaft;

f) rotating said transfer core in a second direction to move said locking rib to remove said wedge between said transfer core and said first wall;

g) removing said transfer core from said lock shaft.

19. The method of claim 18 further comprising the step of:

a) cutting said flexible material on said original core into predetermined widths;

b) cutting said multiple transfer cores into widths substantially equal to said predetermined widths of said flexible material;

c) placing multiple transfers cores, each having a width equal to said predetermined widths, onto said lock shaft;

d) securing an open end of a first of said predetermined widths to a first of said transfer cores;

e) securing an open end of a next of said predetermined widths to a next of said transfer cores;

f) repeating step d) until all open ends are secured to transfer cores;

g) winding said rotatable transfer shaft in a first direction that positions and wedges said locking rib between said transfer core and said first wall to enable said transfer core to rotate in conjunction with said lock shaft;

h) continuing to wind said flexible material onto said transfer core until a predetermined quantity is reached;

i) rotating said transfer core in a second direction that positions and unwedges said locking rib between said transfer core and said second wall;

j) removing said transfer core from said lock shaft.

* * * * *